US009852734B1

(12) United States Patent
Sun et al.

(10) Patent No.: US 9,852,734 B1
(45) Date of Patent: Dec. 26, 2017

(54) SYSTEMS AND METHODS FOR TIME-SCALE MODIFICATION OF AUDIO SIGNALS

(71) Applicants: SYNAPTICS INCORPORATED, San Jose, CA (US); SYNAPTICS LLC, Zug (CH)

(72) Inventors: Zhuojin Sun, Shanghai (CN); Bingsen Xie, Shanghai (CN)

(73) Assignees: SYNAPTICS INCORPORATED, San Jose, CA (US); SYNAPTICS LLC, Zug (CH)

( * ) Notice: Subject to any disclaimer, the term of this patent is extended or adjusted under 35 U.S.C. 154(b) by 148 days.

(21) Appl. No.: 14/250,710

(22) Filed: Apr. 11, 2014

Related U.S. Application Data

(60) Provisional application No. 61/824,112, filed on May 16, 2013.

(51) Int. Cl.
*G10L 19/00* (2013.01)

(52) U.S. Cl.
CPC ..... *G10L 19/00* (2013.01)

(58) Field of Classification Search
None
See application file for complete search history.

(56) References Cited

U.S. PATENT DOCUMENTS 6,232,540 B1 * 5/2001 Kondo ..... G10H 1/42 434/307 A
2007/0269056 A1 * 11/2007 Nakamura ..... G10L 21/04 381/106
2010/0070283 A1 * 3/2010 Kato ..... G10L 21/02 704/278

* cited by examiner

*Primary Examiner* — Marivelisse Santiago Cordero
*Assistant Examiner* — Keara Harris
(74) *Attorney, Agent, or Firm* — Paradice and Li LLP

(57) ABSTRACT

System and methods are provided for modifying audio signals. A waveform representing an audio signal changing over time is received. A first time length is selected. A first starting point in the waveform is selected. A first pair of adjacent segments of the waveform are determined based at least in part on the first starting point and the first time length. The first pair of adjacent segments each correspond to the first time length. A first difference measure associated with the first pair of adjacent segments is calculated. In response to the first difference measure being smaller than a threshold, compression or expansion of the waveform is performed based at least in part on the first time length and the first starting point.

14 Claims, 7 Drawing Sheets

SYSTEMS AND METHODS FOR TIME-SCALE MODIFICATION OF AUDIO SIGNALS

CROSS-REFERENCE TO RELATED APPLICATIONS

This disclosure claims priority to and benefit from U.S. Provisional Patent Application No. 61/824,112, filed on May 16, 2013, the entirety of which is incorporated herein by reference.

FIELD

The technology described in this patent document relates generally to signal processing and more particularly to audio signal processing.

BACKGROUND

An audio signal (e.g., music or speech) usually includes many components, such as pitch, volume, timbre and time. The modification of the time aspect of an audio signal, which is generally referred to as time-scale modification of the audio signal, is very useful for certain applications, such as voice-mail, dictation-tape playback or post synchronization of film and video. FIG. 1(A)-FIG. 1(C) depict example diagrams showing a basic principle of time-scale modifications of an audio signal. As shown in FIG. 1(A), an original audio recording 100 includes segments 102, 104 and 106 of a same time length $L_0$. Time-scale modifications can be performed on the original audio recording 100 to expand or compress the segments. As shown in FIG. 1(B), the segments 102, 104 and 106 are expanded to different extents to have time lengths longer than the original time length $L_0$. On the other hand, as shown in FIG. 1(C), the segments 102, 104 and 106 are compressed to different extents to have time lengths shorter than the original time length $L_0$. Usually, time-scale modifications of an audio signal speed up or slow down the audio signal without changing the pitch of the audio signal which corresponds to a fundamental period of the audio signal.

SUMMARY

In accordance with the teachings described herein, system and methods are provided for modifying audio signals. A waveform representing an audio signal changing over time is received. A first time length is selected. A first starting point in the waveform is selected. A first pair of adjacent segments of the waveform are determined based at least in part on the first starting point and the first time length. The first pair of adjacent segments each correspond to the first time length. A first difference measure associated with the first pair of adjacent segments is calculated. In response to the first difference measure being smaller than a threshold, compression or expansion of the waveform is performed based at least in part on the first time length and the first starting point.

In one embodiment, a system for modifying audio signals includes: one or more data processors and a computer-readable storage medium encoded with instructions for commanding the data processors to execute certain operations. A waveform representing an audio signal changing over time is received. A first time length is selected. A first starting point in the waveform is selected. A first pair of adjacent segments of the waveform are determined based at least in part on the first starting point and the first time length. The first pair of adjacent segments each correspond to the first time length. A first difference measure associated with the first pair of adjacent segments is calculated. In response to the first difference measure being smaller than a threshold, compression or expansion of the waveform is performed based at least in part on the first time length and the first starting point.

In another embodiment, a non-transitory computer readable storage medium includes programming instructions for modifying audio signals. The programming instructions are configured to cause one or more data processors to execute certain operations. A waveform representing an audio signal changing over time is received. A first time length is selected. A first starting point in the waveform is selected. A first pair of adjacent segments of the waveform are determined based at least in part on the first starting point and the first time length. The first pair of adjacent segments each correspond to the first time length. A first difference measure associated with the first pair of adjacent segments is calculated. In response to the first difference measure being smaller than a threshold, compression or expansion of the waveform is performed based at least in part on the first time length and the first starting point.

DETAILED DESCRIPTION

Figure 1:
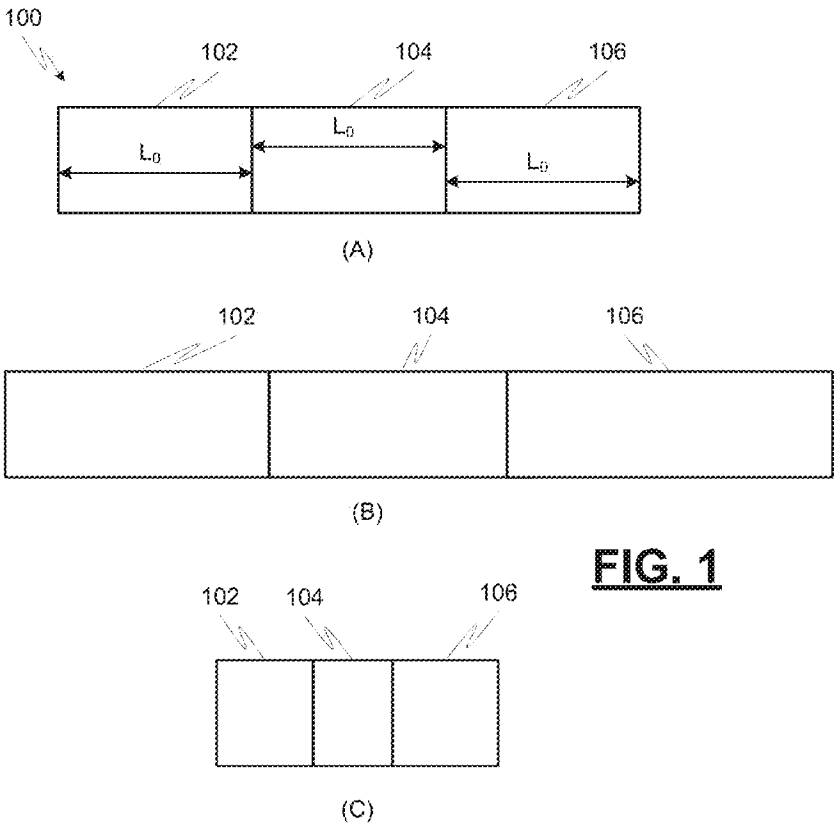
FIG. 1(A)-FIG. 1(C) depict example diagrams showing a basic principle of time-scale modifications of an audio signal.
Figure 2:
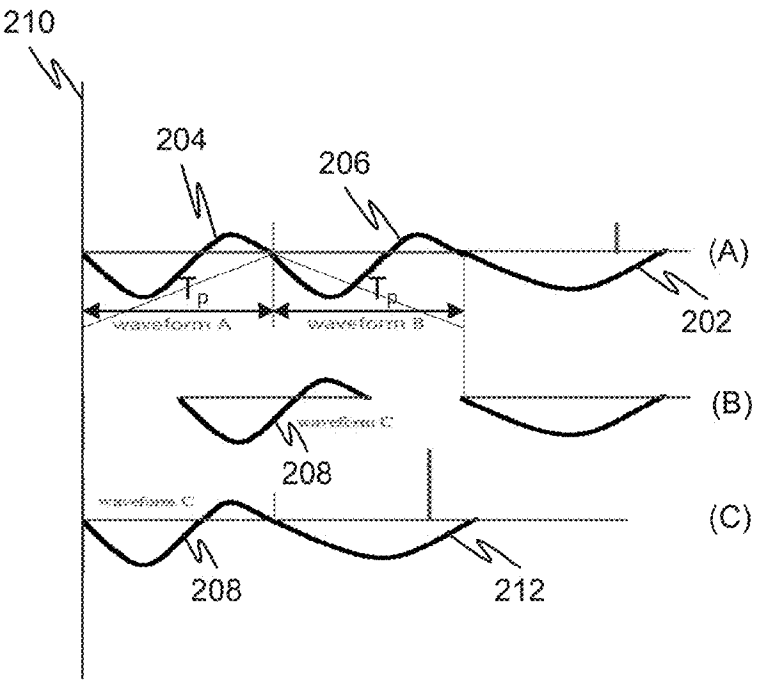
FIG. 2(A)-FIG. 2(C) depict example diagrams showing a process of compressing a waveform using PICOLA.
Figure 3:
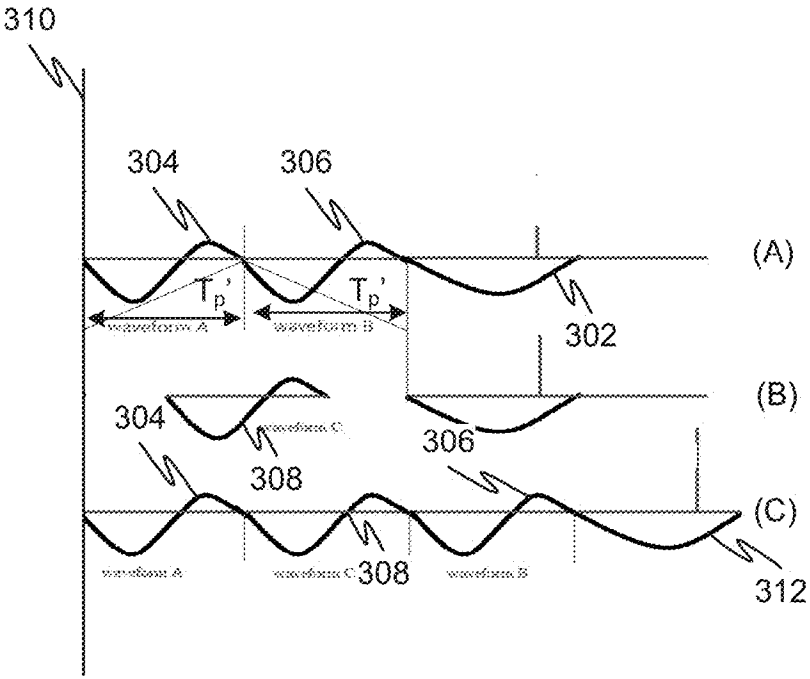
FIG. 3(A)-FIG. 3(C) depict example diagrams showing a process of expanding a waveform using PICOLA.

A Pointer-Interval-Controlled-Overlap-Add (PICOLA) algorithm is frequently used to perform time-scale modifications of an audio signal. FIG. 2(A)-FIG. 2(C) depict example diagrams showing a process of compressing a waveform using PICOLA. A waveform 202 is compressed by replacing segments 204 and 206 with a newly generated segment 208. Specifically, as shown in FIG. 2(A), the waveform 202 represents an audio signal changing over time. The first two segments 204 and 206 of the waveform 202 relative to the initial position 210 are selected, and each of the segments 204 and 206 has a same time length Tp which corresponds to a fundamental period (e.g., pitch) of the audio signal. A new segment 208 having the time length Tp is generated (e.g., overlap-added) based at least in part on the two segments 204 and 206, as shown in FIG. 2(B). Then, the new segment 208 is used to replace the segments 204 and 206. The newly formed waveform 212 is shorter than the waveform 202, which indicates that the audio signal associated with the waveform 202 is sped up. FIG. 3(A)-FIG. 3(C) depict example diagrams showing a process of expanding a waveform using PICOLA. A waveform 302 is expanded by inserting a newly generated segment 308 between segments 304 and 306 of the waveform 302. Specifically, as shown in FIG. 3(A), the first two segments 304 ad 306 of the waveform 302 relative to an initial position 310 are selected, and each of the segments 304 and 306 has a same time length Tp' which corresponds to a fundamental period (e.g., pitch) of the audio signal. A new segment 308 having the time length Tp' is generated based at least in part on the two segments 304 and 306, as shown in FIG. 3(B). Then, the new segment 308 is inserted between the segments 304 and 306. The newly formed waveform 312 is longer than the waveform 302, which indicates that the audio signal associated with the waveform 302 is slowed down. A basic assumption of PICOLA is that the waveform of an audio signal is periodic, and thus the first two segments of the waveform relative to an initial position are selected for pitch detection, as shown in FIG. 2(A) and FIG. 3(A). However, the basic assumption of PICOLA is often not true in reality. For example, a starting point may not be accurately determined. Such deficiencies of PICOLA may cause inaccuracy in results of time-scale modifications under some circumstances.

Figure 4:
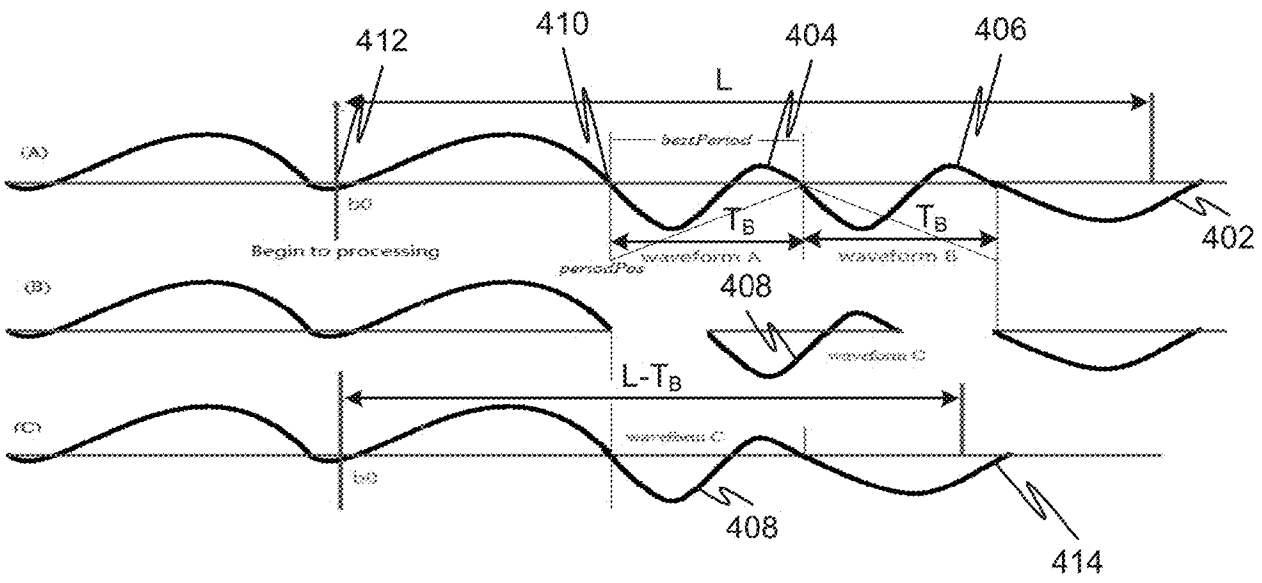
FIG. 4(A)-FIG. 4(C) depict example diagrams showing a process of compressing a waveform.

FIG. 4(A)-FIG. 4(C) depict example diagrams showing a process of compressing a waveform. As shown in FIG. 4(A)-FIG. 4(C), the waveform 402 is compressed by replacing segments 404 and 406 with a newly generated segment 408. Specifically, the waveform 402 represents an audio signal changing with time. Different time lengths and different starting points can be selected and examined to reduce a difference between two adjacent segments that are next to a starting point. A proper time length $T_B$ and a proper starting point 410 (e.g., different from an initial position 412) are determined so that a difference between the segments 404 and 406 that are next to the starting point 410 is smaller than a threshold. Each of the segments 404 and 406 has the same time length $T_H$ which corresponds to a fundamental period (e.g., pitch) of the audio signal. A new segment 408 having the time length $T_B$ is generated (e.g., overlap-added) based at least in part on the two segments 404 and 406, as shown in FIG. 4(B). For example, triangle window functions are used to add the segments 404 and 406 to form the new segment 408. Then, the new segment 408 is used to replace the segments 404 and 406 to form a new waveform 414, as shown in FIG. 4(C). For example, the waveform 402 corresponds to an original sampling length L, and the waveform 414 corresponds to a length L-$T_S$ which is shorter than the original sampling length L.

Figure 5:
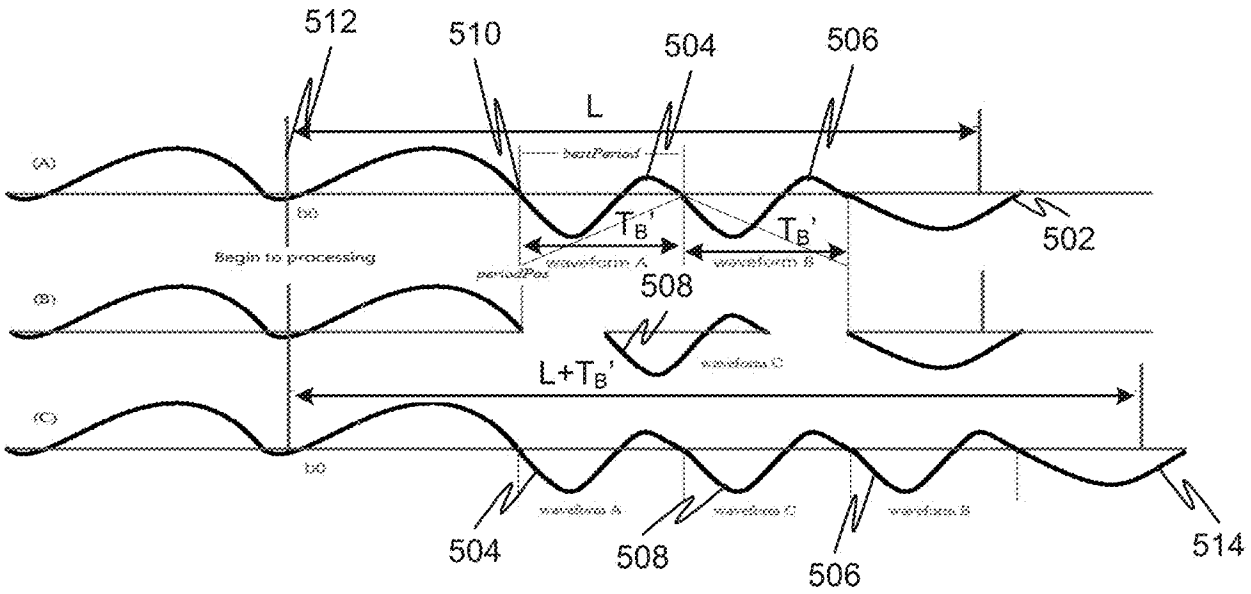
FIG. 5(A)-FIG. 5(C) depict example diagrams showing a process of expanding a waveform.

FIG. 5(A)-FIG. 5(C) depict example diagrams showing a process of expanding a waveform. A waveform 502 is expanded by inserting a newly generated segment 508 between segments 504 and 506 of the waveform 502. As shown in FIG. 5(A), a proper time length $T_B$ and a proper starting point 510 (e.g., different from an initial position 512) are determined so that a difference between the segments 504 and 506 that are next to the starting point 510 is smaller than a threshold. Each of the segments 504 and 506 has the same time length $T_B$ which corresponds to a fundamental period (e.g., pitch) of the audio signal. A new segment 508 having the time length $T_B$ is generated (e.g., overlap-added) based at least in part on the two segments 504 and 506, as shown in FIG. 5(B). Then, the new segment 508 is inserted between the segments 504 and 506 to form a new waveform 514. For example, the waveform 502 corresponds to an original sampling length L, and the waveform 514 corresponds to a length L+$T_B$ which is longer than the original sampling length L.

Figure 6:
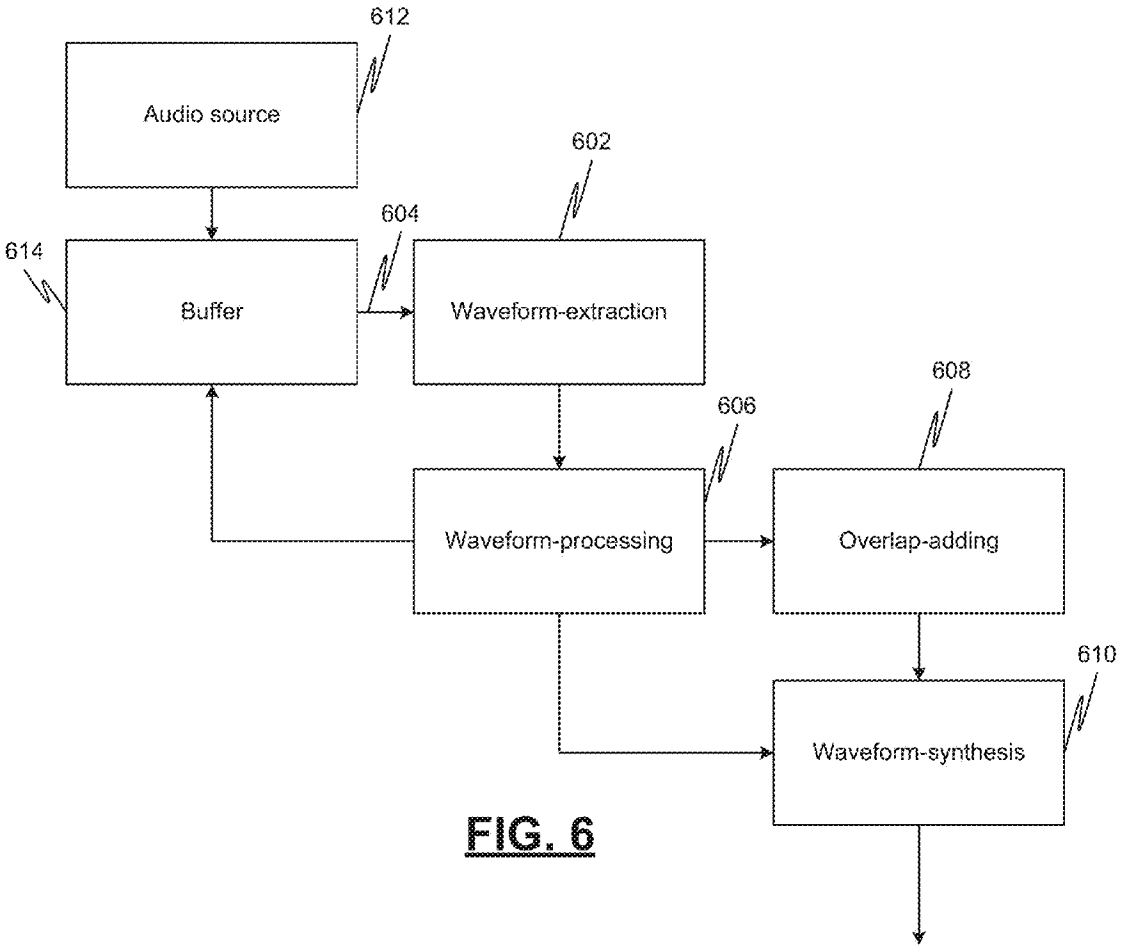
FIG. 6 depicts an example diagram showing a system for performing time-scale modifications of an audio signal.

FIG. 6 depicts an example diagram showing a system for performing time-scale modifications of an audio signal. As shown in FIG. 6, a waveform-extraction component 602 extracts a waveform from an audio signal 604, and a waveform-processing component 606 searches for a proper starting point and a proper time length that corresponds to a fundamental period of the audio signal 604. Once the proper starting point and the proper time length are determined, an overlap-adding component 608 generates a new segment, and a waveform-synthesis component 610 replaces a pair of original segments that are next to the determined starting point with the new segment for compression of the waveform, or inserts the new segment between the pair of original segments for expansion of the waveform.

Specifically, the waveform-processing component 606 selects a time length within a time range. For example, the time range has a lower limit $L_{min}$ and an upper limit $L_{max}$ that are determined as follows:

$$L_{min} = \frac{R_{sample}}{f_h} \qquad L_{max} = \frac{R_{sample}}{f_l} \tag{1}$$

where $R_{sample}$ represents a sample rate, $f_h$ represents a high-pitch frequency (e.g., 600 Hz), and $f_l$ represents a low-pitch frequency (e.g., 40 Hz).

A sampling length L is calculated as follows:

$$L = \begin{cases} Pl \times \frac{\gamma}{\gamma - 1} \gamma > 1 \\ Pl \times \frac{\gamma}{1 - \gamma} 1 > \gamma > 0.5 \end{cases} \tag{2}$$

where Pl represents the selected time length, and γ represents a speed control factor. The waveform-processing component 606 selects a starting point, shiftPos, within a position range, for example, [0, L−2×Pl]. Then, the waveform-processing component 606 calculates a difference measure, $E_{shiftPos}$, associated with two adjacent segments that are next to the selected starting point. The difference measure, $E_{shiftPos}$, is determined as follows:

$$E_{shiftPos}(Pl) = \frac{1}{Pl} \sum_{n=0}^{Pl-1} |x(shiftPos + n) - y(shiftPos + pl + n)| \tag{3}$$

where shiftPos represents the selected starting point, $E_{shiftPos}$ (Pl) represents the difference measure, x(shiftPos+n) represents a first point on one of the two adjacent segments, and y(shiftPos+Pl+n) represents a second point on the other of the two adjacent segments that corresponds to the first point.

If the difference measure is smaller than a threshold value, the waveform-processing component 606 outputs the two adjacent segments that are next to the selected starting point to the overlap-adding component 608 that generates a new segment based on the two adjacent segments. In addition, the waveform-processing component 606 outputs the selected starting point shiftPos and the selected time length Pl to the waveform-synthesis component 610 which outputs a newly generated waveform. For example, the waveform-synthesis component 610 generates the new waveform by replacing the two adjacent segments that are next to the selected starting point with the new segment or inserting the new segment between the two adjacent segments.

If the difference measure is no smaller than the threshold value but is smaller than a difference value stored in a storage unit (e.g., a register) that is no smaller than the threshold value, the waveform-processing component 606 replaces the temporary difference value with the difference measure in the storage unit. In addition, the waveform-processing component 606 saves the selected starting point and the selected time length (e.g., in one or more storage units). Furthermore, the waveform-processing component 606 selects another starting point (e.g., based on performance demands) within the position range and provides the selected starting point to the buffer 614 for another cycle of processing. If the difference measure is no smaller than the stored difference value, the waveform-processing component 606 directly selects another starting point within the position range for another cycle of processing without replacing the difference value.

If there is no other starting point that can be selected and the difference measure is no smaller than the threshold value, the waveform-processing component 606 selects another time length within the time range, and another sampling length is calculated. Then, the waveform-processing component 606 selects another starting point based on the newly selected time length and the newly calculated sampling length for another cycle of processing.

If no other starting point and no other time length can be selected and the difference measure is no smaller than the threshold value, the waveform-processing component 606 selects a particular starting point and a particular time length that are stored in the storage unit and are related to a smallest difference measure.

Figure 7:
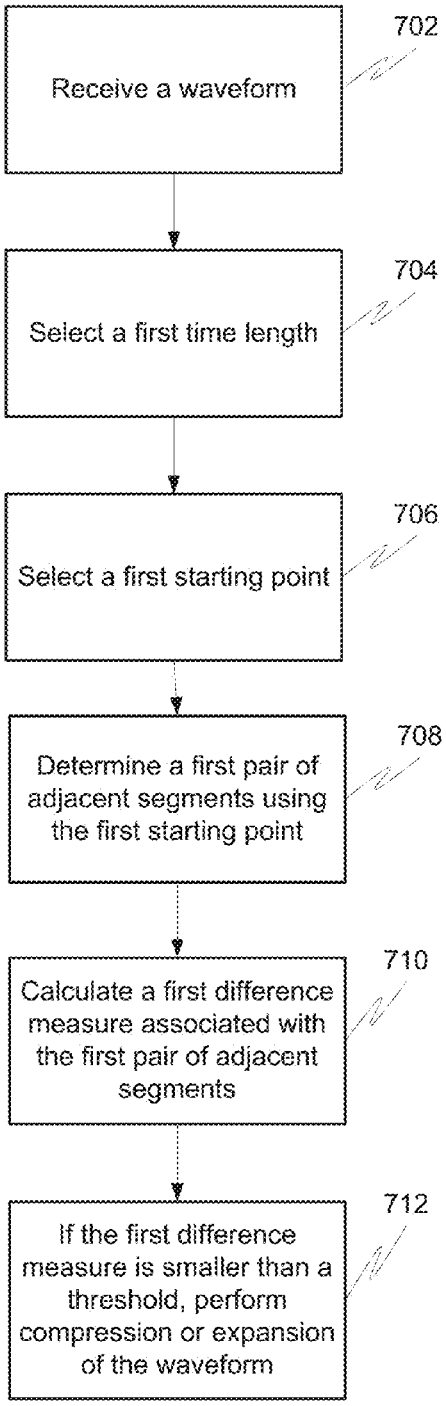
FIG. 7 depicts an example diagram showing a process for modifying audio signals.

FIG. 7 depicts an example diagram showing a process for modifying audio signals. At 702, a waveform representing an audio signal changing over time is received. At 704, a first time length is selected. At 706, a first starting point in the waveform is selected. At 708, a first pair of adjacent segments of the waveform are determined using the first starting point. The first pair of adjacent segments each correspond to the first time length. At 710, a first difference measure associated with the first pair of adjacent segments is calculated. At 712, in response to the first difference measure being smaller than a threshold, compression or expansion of the waveform is performed based at least in part on the first time length and the first starting point.

This written description uses examples to disclose the invention, include the best mode, and also to enable a person skilled in the art to make and use the invention. The patentable scope of the invention may include other examples that occur to those skilled in the art. Other implementations may also be used, however, such as firmware or appropriately designed hardware configured to carry out the methods and systems described herein. For example, the systems and methods described herein may be implemented in an independent processing engine, as a co-processor, or as a hardware accelerator. In yet another example, the systems and methods described herein may be provided on many different types of computer-readable media including computer storage mechanisms (e.g., CD-ROM, diskette, RAM, flash memory, computer's hard drive, etc.) that contain instructions (e.g., software) for use in execution by one or more processors to perform the methods' operations and implement the systems described herein.

What is claimed is:

1. A method comprising:

receiving a waveform representing an audio signal changing over time;

selecting a first time length;

selecting a first starting point in the waveform;

determining a first segment pair comprising contiguous first and second segments of the waveform such that (i) the second segment follows the first segment, (ii) the first starting point identifies a beginning of the first segment, and (iii) the first time length identifies the length of each of the first and second segments;

calculating a first difference measure associated with the first pair of segments;

in response to the first difference measure being greater than a threshold, selecting a second starting point in the waveform, that is different than the first starting point;

determining a second segment pair comprising contiguous third and fourth segments of the waveform such that (i) the fourth segment follows the third segment, (ii) the second starting point identifies a beginning of the third segment and (iii) the first time length identifies the length of each of the third and fourth segments;

calculating a second difference measure associated with the second pair of segments; and in response to the second difference measure being smaller than the threshold, performing time-compression or time-expansion of the waveform based at least in part on the first time length and the second starting point.

2. The method of claim 1, wherein if the first starting point is a last starting point in the waveform, then, selecting a second time length prior to selecting the second starting point in the waveform, wherein the third and fourth segments each corresponds to the second time length.

3. The method of claim 1, wherein:

the first time length is in a range from a lower limit to an upper limit;

the lower limit is associated with a sample rate and a low-pitch frequency; and the upper limit is associated with the sample rate and a high-pitch frequency.

4. The method of claim 1, wherein the first starting point is selected within a sample length of the waveform determined based at least in part on the first time length.

5. The method of claim 1, wherein the performing of the time-compression includes:

generating a new segment based at least in part on the second segment pair; and replacing the second segment pair with the new segment.

6. The method of claim 1, wherein the performing of the time-expansion of includes:

generating a new segment based at least in part on the second segment pair; and inserting the new segment between the second segment pair.

7. The method of claim 1, wherein:

each of the first and second segment pairs includes a front segment and a back segment;

the difference measure is determined as follows:

$$E_{shiftPos}(Pl) = \frac{1}{Pl}\sum_{n=0}^{Pl-1} |x(shiftPos + n) - y(shiftPos + pl + n)|$$

where Pl represents the first time length, shiftPos represents the first starting point, $E_{shiftPos}(Pl)$ represents the difference measure, x(shiftPos+n) represents a first point on the front segment, and y(shiftPos+Pl+n) represents a second point on the back segment that corresponds to the first point.

8. A system for comprising:

one or more data processors; and a computer-readable storage medium encoded with instructions for commanding the data processors to execute operations including:

receiving a waveform representing an audio signal changing over time;

selecting a first time length;

selecting a first starting point in the waveform;

determining a first segment pair comprising contiguous first and second segments of the waveform such that (i) the second segment follows the first segment, (ii) the first starting point identifies a beginning of the first segment, and (iii) the first time length identifies the length of each of the first and second segments;

calculating a first difference measure associated with the first pair of segments;

in response to the first difference measure being greater than a threshold, selecting a second starting point in the waveform, that is different than the first starting point;

determining a second segment pair comprising contiguous third and fourth segments of the waveform such that i) the fourth segment follows the third segment, (ii) the second starting point identifies a beginning of the third segment and iii) the first time length identifies the length of each of the third and fourth segments;

calculating a second difference measure associated with the second pair of segments; and in response to the second difference measure being smaller than the threshold, performing time-compression or time-expansion of the waveform based at least in part on the first time length and the second starting point.

9. The system of claim 8, wherein if the first starting point is a last starting point in the waveform, then selecting a second time length prior to selecting the second starting point in the waveform, wherein the third and fourth segments each corresponds to the second time length.

10. The system of claim 8, wherein:

the first time length is in a range from a lower limit to an upper limit;

the lower limit is associated with a sample rate and a low-pitch frequency; and the upper limit is associated with the sample rate and a high-pitch frequency.

11. The system of claim 8, wherein:

each of the first and second segment pairs includes a front segment and a back segment;

the difference measure is determined as follows:

$$E_{shiftPos}(Pl) = \frac{1}{Pl}\sum_{n=0}^{Pl-1} |x(shiftPos+n) - y(shiftPos+pl+n)|$$

where Pl represents the first time length, shiftPos represents the first starting point, $E_{shiftPos}$(Pl) represents the difference measure, x(shiftPos+n) represents a first point on the front segment, and y(shiftPos+Pl+n) represents a second point on the back segment that corresponds to the first point.

12. A non-transitory computer readable storage medium comprising programming instructions for modifying audio signals, the programming instructions configured to cause one or more data processors to execute operations comprising:

receiving a waveform representing an audio signal changing over time;

selecting a first time length;

selecting a first starting point in the waveform;

determining a first segment pair comprising contiguous first and second segments of the waveform such that i) the second segment follows the first segment, (ii) the first starting point identifies a beginning of the first segment, and iii) the first time length identifies the length of each of the first and second segments;

calculating a first difference measure associated with the first pair of segments;

in response to the first difference measure being greater than a threshold, selecting a second starting point in the waveform, that is different than the first starting point;

determining a second segment pair comprising contiguous third and fourth segments of the waveform such that (i) the fourth segment follows the third segment, (ii) the second starting point identifies a beginning of the third segment and (iii) the first time length identifies the length of each of the third and fourth segments;

calculating a second difference measure associated with the second pair of segments; and in response to the second difference measure being smaller than the threshold, performing time-compression or time-expansion of the waveform based at least in part on the first time length and the second starting point.

13. The storage medium of claim 12, wherein if the first starting point is a last starting point in the waveform, then selecting a second time length prior to selecting the second starting point in the waveform wherein the third and fourth segments each corresponds to the second time length.

14. The storage medium of claim 12, wherein:

each of the first and second segment pairs includes a front segment and a back segment;

the difference measure is determined as follows:

$$E_{shiftPos}(Pl) = \frac{1}{Pl}\sum_{n=0}^{Pl-1} |x(shiftPos+n) - y(shiftPos+pl+n)|$$

where Pl represents the first time length, shiftPos represents the first starting point, $E_{shiftPos}$(Pl) represents the difference measure, x(shiftPos+n) represents a first point on the front segment, and y(shiftPos+Pl+n) represents a second point on the back segment that corresponds to the first point.

* * * * *